US006823763B1

(12) United States Patent
Foster et al.

(10) Patent No.: US 6,823,763 B1
(45) Date of Patent: Nov. 30, 2004

(54) AUTOMATED GARMENT PIECE CUTTER

(75) Inventors: Wayne G. Foster, Winston-Salem, NC (US); Ken J. Thompson, Lexington, NC (US); John R Everhart, Winston-Salem, NC (US); Erik D. Moore, Lexington, NC (US); Joel C. Rosenquist, Kernersville, NC (US); Michael D. Hines, Lewisville, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 08/865,324

(22) Filed: May 30, 1997

(51) Int. Cl.[7] ..... B26D 7/01; B26D 7/18; B26D 7/20; B26D 7/32

(52) U.S. Cl. ..... 83/100; 83/152; 83/155; 83/451; 83/937; 83/939; 269/21

(58) Field of Search ..... 83/152, 155, 451, 83/936, 937, 938, 939, 940, 941, 27, 151, 280, 281, 23, 29, 100; 269/21

(56) References Cited

U.S. PATENT DOCUMENTS 2,572,640 A * 10/1951 Lovegrove ..... 269/21 X
3,406,938 A * 10/1968 Muir, Jr. ..... 269/21 X
3,495,492 A * 2/1970 Gerber et al. ..... 83/451 X
3,848,327 A * 11/1974 Gerber et al. ..... 269/21 X
4,328,726 A * 5/1982 Pearl ..... 83/39
4,345,496 A * 8/1982 Pearl ..... 83/100
4,452,113 A * 6/1984 Pearl ..... 83/152 X
5,193,423 A * 3/1993 Bakker ..... 83/152 X
5,463,921 A * 11/1995 Bellio et al. ..... 83/152 X
5,699,707 A * 12/1997 Campbell, Jr. ..... 83/152 X
5,727,434 A * 3/1998 Dils et al. ..... 83/451 X

* cited by examiner

*Primary Examiner*—Clark F. Dexter
(74) *Attorney, Agent, or Firm*—Womble Carlyle Sandridge & Rice, PLLC

(57) ABSTRACT

A fabric cutting system for cutting a pre-selected pattern from a fabric stock and transferring the cut fabric piece to a workstation. The system includes a cutter assembly for cutting the preselected pattern from the fabric stock. A configurable pickup assembly is located between the cutter assembly and the workstation and adapted to pick-up and transfer the cut fabric piece to the workstation. A hold down table adjacent to the cutter assembly maintains the position of the fabric stock in a determinable relationship to the position of the cutter assembly and the configurable pickup assembly. In the preferred embodiment, the hold down table is vacuum operated and includes a moving mesh belt on which and the fabric stock is moved downstream towards the pickup assembly as the fabric piece is being cut by the cutter assembly. This arrangement results in substantially higher throughput through the fabric cutting system.

18 Claims, 10 Drawing Sheets

AUTOMATED GARMENT PIECE CUTTER

BACKGROUND OF THE INVENTION (1) Field of the Invention

The present invention relates generally to automated manufacturing systems and, more particularly, to an apparatus for precisely and automatically cutting a garment piece from a roll of fabric stock for subsequent automatic assembly into a finished sleeve or pant leg for a sweat suit or the like.

(2) Description of the Prior Art

The manufacture of textile clothing articles such as sweat suits and outer garments has resisted automation. This is due largely because of the difficulty in accurately handling so called "soft" materials. For example, the fleece material commonly used in sweat suits may wrinkle, stick to one another and stretch significantly when handled.

Even where automation has begun to make in-roads, other difficulties remain. For example, sleeves and pant legs must be sewn "inside out" in order to make a garment having clean seams. This has always been a manual operation because of the dexterity required to locate the cut fabric piece, inspect it for defects and feed it into the sewing machine. Unfortunately, repetitive actions such as sewing a garment may cause health problems. However, it has been extremely difficult to design a device which can reliably locate, inspect and cut a fabric piece for subsequently finishing a garment piece such as a sleeve or pant leg time after time.

Thus, there remains a need for an apparatus for automatically cutting a sleeve or pant leg for a sweat suit or the like which will operate reliably time after time while, at the same time, it can be carried out completely automatically without the need for a skilled operator.

SUMMARY OF THE INVENTION

The present invention is directed to a fabric cutting system for cutting a pre-selected pattern from a fabric stock and transferring the cut fabric piece to a workstation. The system includes a cutter assembly for cutting the preselected pattern from the fabric stock. A configurable pickup assembly is located between the cutter assembly and the workstation and adapted to pickup and transfer the cut fabric piece to the workstation.

In the preferred embodiment, the pickup assembly includes a vacuum plenum having at least one generally flat surface; a plurality of orifices arranged about the surface; means for selectively closing at least a portion of the orifices generally corresponding to the shape of the cut fabric piece; and a controller attached to the vacuum plenum for positioning the vacuum plenum, whereby the cut fabric piece is picked up and transferred to the workstation.

A hold down table adjacent to the cutter assembly maintains the position of the fabric stock in a determinable relationship to the position of the cutter assembly and the configurable pickup assembly. In the preferred embodiment, the hold down table is vacuum operated and includes a moving mesh belt on which the fabric stock is moved downstream towards the pickup assembly as the fabric piece is being cut by the cutter assembly. This arrangement results in substantially higher throughput through the fabric cutting system.

Accordingly, one aspect of the present invention is to provide a fabric cutting system for cutting a preselected pattern from a fabric stock and transferring the cut fabric piece to a workstation. The system includes: (a) a cutter assembly for cutting the preselected pattern from the fabric stock; and (b) a configurable pickup assembly located between the cutter assembly and the workstation and adapted to pick-up and transfer the cut fabric piece to the workstation.

Another aspect of the present invention is to provide a configurable pickup assembly for picking up a cut fabric piece and transferring the cut fabric piece to a workstation. The pickup assembly includes: (a) a vacuum plenum having at least one generally flat surface; (b) a plurality of orifices arranged about the surface; (c) means for selectively closing at least a portion of the orifices generally corresponding to the shape of the cut fabric piece; and (d) a controller attached to the vacuum plenum for positioning the vacuum plenum, whereby the cut fabric piece is picked up and transferred to the workstation.

Still another aspect of the present invention is to provide a fabric cutting system for cutting a preselected pattern from a fabric stock and transferring the cut fabric piece to a workstation. The system includes: (a) a cutter assembly for cutting the preselected pattern from the fabric stock; (b) a configurable pickup assembly located between the cutter assembly and the workstation and adapted to pick-up and transfer the cut fabric piece to the workstation, the pickup assembly including: (i) a vacuum plenum having at least one generally flat surface; (ii) a plurality of orifices arranged about the surface; (iii) means for selectively closing at least a portion of the orifices generally corresponding to the shape of the cut fabric piece; and (iv) a controller attached to the vacuum plenum for positioning the vacuum plenum, whereby the cut fabric piece is picked up and transferred to the workstation; and (c) a hold down table adjacent to the cutter assembly to maintain the position of the fabric stock in a determinable relationship to the position of the cutter assembly and the configurable pickup assembly.

These and other aspects of the present invention will become apparent to those skilled in the art after a reading of the following description of the preferred embodiment when considered with the drawings.

DESCRIPTION OF THE PREFERRED EMBODIMENTS

Figure 1:
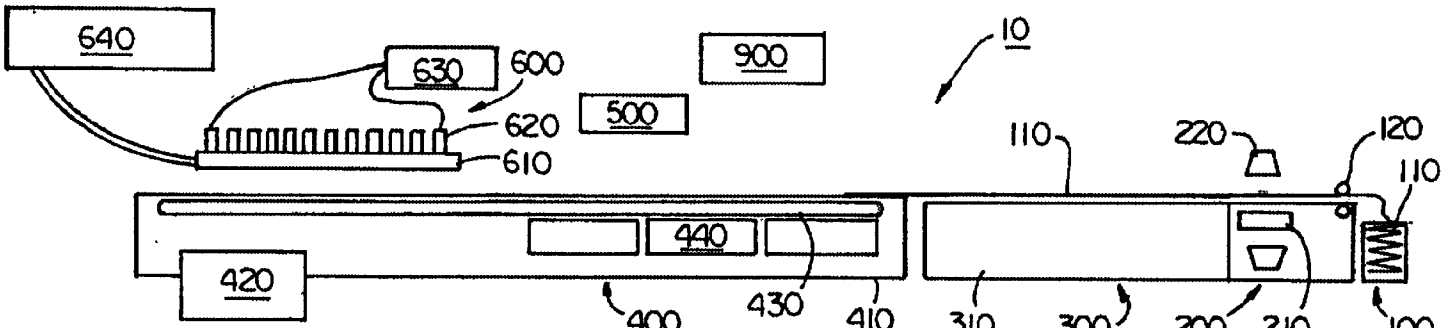
FIG. 1 is a side view of a fabric cutting system constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, an automated garment piece cutting system, generally designated 10, is shown constructed according to the present invention. The cutting system 10 includes, in a preferred embodiment, a feed station 100, inspection station 200, alignment station 300, conveyor 400, cutter assembly 500, pickup assembly 600, at least one stacking station 700, a waste station 800 and a controller 900.

Figure 2:
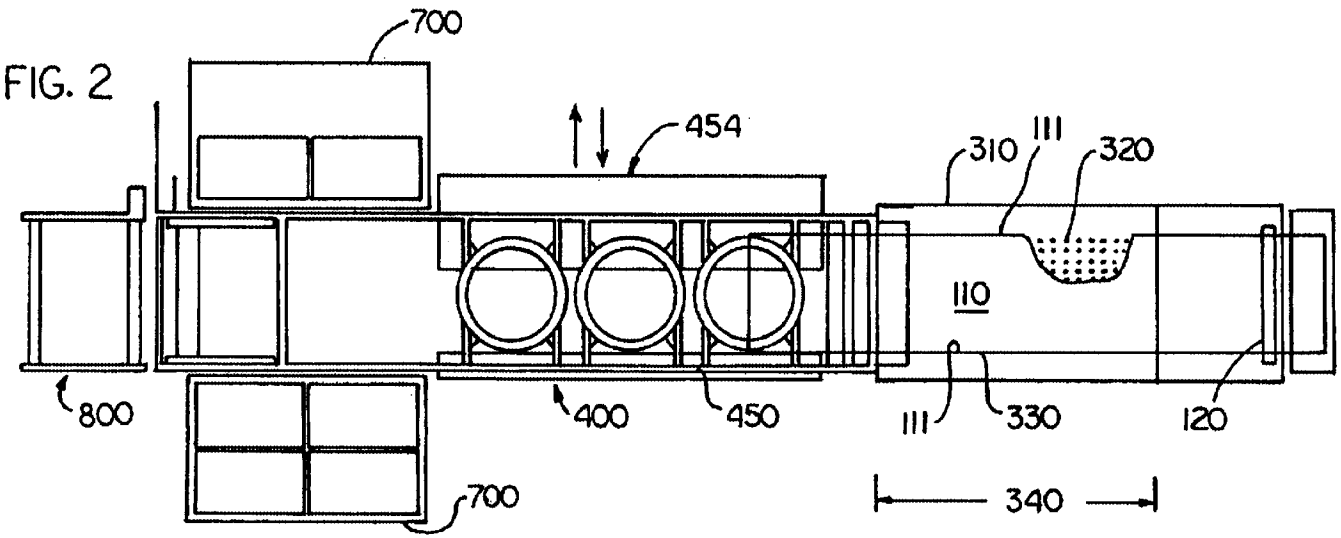
FIG. 2 is a top view of the fabric cutting system.

For ease of reference, and as shown in FIGS. 1 and 2, the X-Axis is defined as along the horizontal or major axis of the cutting system; the Y-axis is along the minor axis of the cutting system; and the Z-axis is upwards, coming out of the paper or figure in FIG. 2. The angle theta ($\theta$) is rotationally about the Z-axis.

The feed station 100 of FIG. 1 is comprised of stock fabric 110, which can be disposed in an accordion stock, or on a web roll (not shown). Various rollers 120 can be used to control the move, tension and/or guide the stock to the next station.

From the feed station 100, the fabric stock travels to the inspection station 200. At the this station, at least two types of inspection functions can occur. One, defects such as tears, perforations or thin spots can be located. Knowing the position of such defects allows subsequent processes to make optimum use of stock and reduce waste. In other words, just as one may adjust his steps when walking to avoid a puddle, the desired cut pattern or patterns can be shifted up, back or to the side to skip over the defect. Detection apparatus, which are well known in the art, can include the use of a light table 210 and a detection camera 220. While many such detection systems can be used, one preferred embodiment includes the combination of a model MV-19 controller manufactured by Adept Technology, Inc. and a model ™ 9701 video camera manufactured by Pulnix, Inc. Defects are registered and stored in the controller 900 for use by the cutter assembly 500 and pickup assembly 600.

In addition to inspecting for defects, the inspection station 200 also can track stock width. Like defect information, the stock width proves important as the controller 900 determines the optimal layout of the pattern or patterns for subsequent cutting and pickup. Width can be determined using a reference plate (not shown), painted in black and white stripes in anticipating of light and dark colored fabric, and a detection camera.

In a preferred embodiment, the light table 210 and the detection camera 220 also detects stock width. Like the defect information, stock width information is sent to and stored in the controller 900, for use in operating the cutter assembly 500 and pickup assembly 600. The importance of stock width is discussed in further detail below.

The alignment station 300 comprises, in a preferred embodiment, an air flotation table 310, with a plurality of forced air holes 320 pointed towards a reference fence 330. During operation, the fabric stock is positioned by the air flotation table so that one edge is moved towards and aligned with a predetermined major or X-axis of the flotation table. This alignment permits the edge to become a reference point for subsequent calculations and layout of pre-selected patterns. Air flotation tables are well known in the art.

Alternatively, mechanical spreaders or positioners (not shown) could be used to attempt to ensure that the fabric stock is placed along a determinable reference line and to ensure that the stock is conveyed in its full width. However, the stock should not be subjected to so much tension to cause the stock to stretch while being cut. Cutting stretched fabric will cause improper patterns when the fabric relaxes.

The alignment station 300 also can add a length 340 to the travel of fabric stock. This length 340 can be approximately the length of two, three or more pattern lengths, so that more stock length is available for adjustments as needed by the controller 900 to optimally locate defects. For example, if a large defect is detected, the controller 900 will have more patterns upstream of the cutter assembly 500 in which to optimally locate the defect and minimize waste. The more stock travel length ahead of the cutter, the more choices available to the controller when deciding whether to skip, shift or adjust the pattern layouts to account for defects.

The conveyor 400 comprises, in a preferred embodiment, a wire mesh belt 410, a belt drive 420, and a hold down table 430. The hold down table 430 comprises at least one vacuum source 440, so that the fabric stock is held down by an adequate amount of pressure. Maintaining a pressure on the fabric stock serves many purposes, including: (1) pulling the stock from the feed station 100; (2) counteracting the tendency of the stock to move due to the forces imparted on the stock by the cutter assembly 500 during cutting; and (3) maintaining the relative position of the stock and defects, if any, as the stock moves to the cutting and pickup assembly. Vacuum sources also are well known in the art. Examples include a transvector Model 914, manufactured by VORTEC, Inc. of Cincinnati, Ohio.

While the stock 110 needs to be held down by suitable pressure on the hold down table 430 and mesh 410, the edges of the stock should not be subjected to the same amount of pressure when some forms of cutter assemblies are used. For example, where a shear cutter method is used, the edges 111 of the stock 110 must allow the base or foot of a shear cutter to slip underneath the stock. Thus, vacuum area reduction plates 450 and 454 can be used. In a preferred embodiment, plate 450 is fixed, extending slightly under the stock edge 111 so that very little pressure is asserted along edge 111 by the vacuum. Plate 454, on the other hand, is adjustable based upon the width of the stock as measured at the inspection station 200. Thus, in operation, an operator (not shown) or controller 900 can initially adjust the plate 454 when new fabric stock is loaded, and then the plate 454 can adjust as needed "on the fly" during the run depending upon width variations encountered. The adjustment can occur by an operator or, in a preferred embodiment, by the controller 900 based upon dynamic width measurements received from the inspection station 200. With some fabric stock, the width will vary during a run. Measuring the width continuously allows the controller to reposition plate 454 as needed during a run. based upon the width of the stock as measured at the inspection station 200. Thus, in operation, an operator (not shown) or controller 900 can initially adjust the plate 454 when new fabric stock is loaded, and then the plate 454 can adjust as needed "on the fly" during the run depending upon width variations encountered. The adjustment can occur by an operator or, in a preferred embodiment, by the controller 900 based upon dynamic width measurements received from the inspection station 200. With some fabric stock, the width will vary during a run. Measuring the width continuously allows the controller to reposition plate 454 as needed during a run.

The cutter assembly 500 can employ any precision cutting assembly suitable to cut the stock fabric used. In a preferred embodiment, the cutter assembly must be capable of cutting a pre-selected pattern into the stock fabric. The cutter assembly must be able to vary the position of the pattern on the stock, as well as the frequency in which any particular pattern is cut.

A cutter assembly 500 is shown in FIG. 1. The assembly allows cutting to occur in the X and Y directions and rotate (theta) to cut the pre-selected patterns from the stock fabric 110. Further, the assembly is raised and lowered in the Z direction during position changes not involving cutting, or to cut non-planar fabric stock if necessary. The cutter assembly can, in a preferred embodiment, cut the pattern while the stock fabric is moving or being conveyed. The stock continues to be held down during cutting by the hold down table as discussed previously. A more detailed discussion of the cutter assembly accompanies the discussion of FIGS. 3 and 4 below.

After at least one pre-selected pattern is cut from the stock fabric 110, the conveyor transports the stock fabric to the pickup assembly 600. The assembly 600 comprises a vacuum plenum 610, a plurality of valve cylinder assemblies 620, a valve actuator 630 and a vacuum generator 640. All of the components of the pickup assembly 600 can physically be located on the plenum 610. In a preferred embodiment, however, the vacuum plenum 610 and valve cylinder assemblies 620 move, with the remaining components remaining fixed but connected via flexible pressure tubing.

In a preferred embodiment, the vacuum plenum 610 and valve cylinder assemblies 620 can be constructed to move along the X, Y and Z axis. In this configuration, the vacuum plenum moves with the conveyor while the pickup function is accomplished.

In another preferred embodiment, the vacuum plenum 610 remains fixed in the X direction, moving only up and down (Z direction) and along the Y axis. In operation, the conveyor can stop beneath the pickup assembly 600. The vacuum plenum 610 then lowers, acquires the desired cut pattern only and leaves the remaining cut patterns or the waste on the conveyor for later pickup or disposal as appropriate. The vacuum plenum 610 then raises, moves along the Y axis to one of the stacking stations 700, and places the cut pattern with the stack in a pre-determined fashion. The vacuum plenum 610 then returns to its initial position above the stock fabric for either picking up additional cut patterns from the same conveyor location, or waiting until additional cut stock is conveyed into position. When the pickup assembly is not picking up cut patterns, the conveyor can move along, allowing the waste to be removed or dropped off into the waste station 800. A further discussion of the vacuum plenum 610 and valve cylinder assemblies 620 is found below accompanying the discussion of FIGS. 5 and 6.

Figure 3:
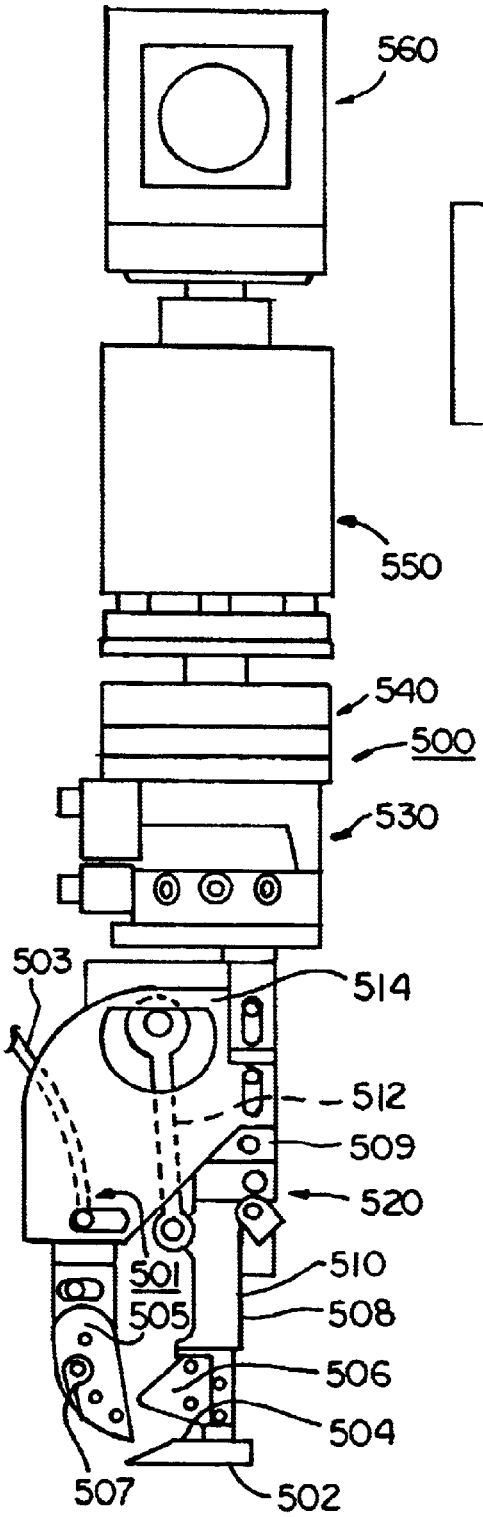
FIG. 3 is a side view of a cutter assembly for use in the fabric cutting system.

FIG. 3 shows a side view of the cutter assembly 500. The assembly is comprised of a cutter head 520, tool changer 530, crash protection device 540, pneumatic slide 550, and theta axis servo 560. The cutter head uses a shear-type precision cutter, with a replaceable lower blade 504 and a replaceable upper blade 506. The foot 502 of the cutter head slides under and lifts the stock fabric, positioning the stock fabric for cutting by the blades. The upper blade 506 is attached to a sleeve 508. Sleeve 508 is rotatably and slidably mounted onto shaft 510. During cutting, the blades are activated by moving the sleeve 508 downward along the shaft 510, so that the upper blade 506 and lower blade 504 overlap to cut the fabric stock. The upper blade 506 is connected to a connecting rod 512, which is eccentrically mounted on motor 514. Due to an offset mounting of about 0.150 inches, the upper blade 506 has approximately 0.300 inches of travel in a preferred embodiment.

The crash protection device 540 detects obstructions encountered by the cutter assembly during movement, shutting down operation when appropriate. In the preferred embodiment, the crash protection device includes an adjustable breakaway which sends a stop signal to controller 900. The pneumatic slide 550 and the theta axis servo 560 allow movement in the Z and theta directions.

Figure 4:
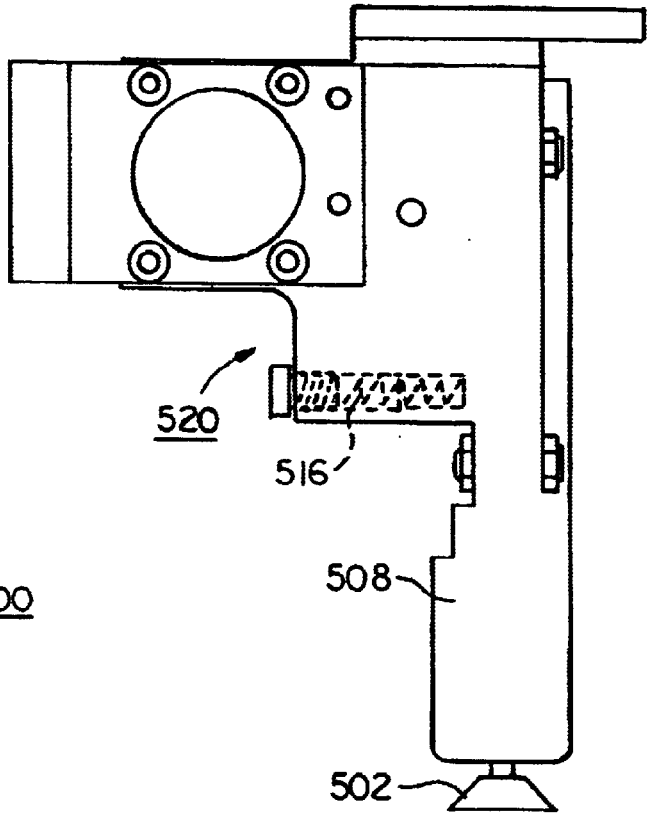
FIG. 4 is a rear view of the cutter head and cutter assembly.

As shown in FIGS. 3 and 4, the top blade 506 is biased axially about shaft 510 horizontally against the lower blade 504 due to spring 516. Spring 516 is disposed horizontally against the upper portion of flange 509 (as shown in FIG. 3), extending from sleeve 508. Thus, the top blade 506 is under constant spring tension about the shaft 510, ensuring that the blades attempt to stay in correct proximity to one another during shearing.

In yet another preferred embodiment, a pneumatic cloth feed assembly 501 is also disposed on the cutter assembly 500 as shown in FIG. 3. In order to assist the shearing operation of the stock fabric, an air source is aimed towards the cutter to help ensure proper placement of the fabric in the blades. An air or gas source is provided through a tube 503, into a housing 505. Air is channeled out of the housing 505 through a diverter 507. The discharging air follows the path of the housing towards the blades. Due to the pressure differentials created, the fabric is properly forced or placed into the blades for shearing.

Although a shear-type precision cutter is discussed above, it is the objective of this invention that any precision cutter could be used. Other examples include laser cutters, die cutters, water jets and rotary blades.

Figure 5:
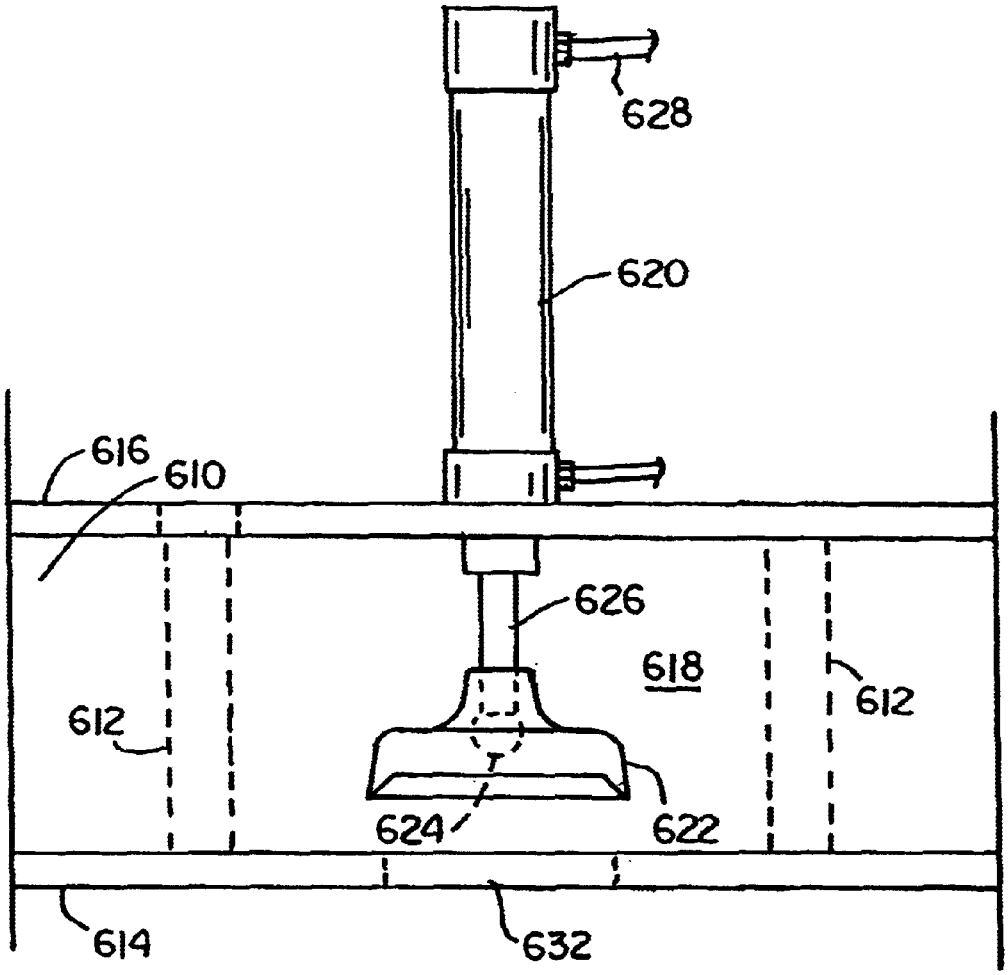
FIG. 5 is a partial cross section view of a vacuum plenum and valve cylinder assembly used to pick-up and transport a cut fabric piece to a downstream workstation.

FIG. 5 is a partial cross section of the vacuum plenum 610 and one valve cylinder assembly 620. The vacuum plenum 610 maintains a required degree of structural rigidity in part due to posts 612, disposed in a space 618 between planar surfaces 614 (lower) and 616 (upper). In a preferred embodiment, a vacuum of between about 3 to 4 inches of water is applied to the plenum. Vacuum ports 633 are disposed in a vacuum port array 632, with numerous vacuum port arrays located throughout the lower planar surface 614. Vacuum ports can range in shape and diameter, but in a preferred embodiment range from about 0.1 to 0.2 inches in diameter. Approximately 20 vacuum ports comprise each array. Between about 200 to 300 vacuum port arrays are spread out in a determined pattern on the bottom surface of the vacuum plenum, with a density of between about ½ to 2 arrays per square inch. Accordingly, the number of vacuum ports is between about 18 to 30 per square inch.

Positioned axially above each vacuum port array is a poppet valve 622. The poppet valve 622 is coupled to the spherical rod end 624, which helps ensure angular compliance and an effective pressure seal over a vacuum port array. The spherical rod end 624 is at one end of a push rod 626, which is biased in the up position within air cylinder 620. An air source 628, which is connected to the valve actuator 630, actuates the air cylinder, forcing the push rod 626 and poppet valve 622 downward to engage the interior of the lower planar surface 614 creating a seal. When sealed in this manner, the vacuum created at the vacuum ports is neutralized, which causes no fabric stock to become attached or adhered thereto.

During operation, the controller 900 communicates with the pickup assembly 600, indicating the desired cut pattern that requires pickup and transfer. The vacuum plenum 610 then is placed under negative pressure. Next, the vacuum plenum 610 lowers over the fabric stock 10; the port arrays that are not located within the shape of the pre-selected pattern are then sealed by operation of the associated valve cylinder assemblies 620. The vacuum plenum 610 then lifts by vacuum pressure the desired cut pattern off the mesh belt 410, while the stock waste remains. The cut pattern is held by the vacuum created through the vacuum ports 633. The vacuum plenum 610 then moves to the desired stacking station 700, and deposits the cut pattern by reducing or turning off the vacuum on the vacuum plenum 610. Although the cut pattern could be released by actuating the corresponding valve cylinder assemblies 620 atop the vacuum ports 632 holding the cut pattern, this proves undesirable for fabric. It was discovered that fibers of fabric stock became pinched between the poppet valve 622 and the interior of the bottom planar surface 614, thus degrading the surface quality of the stock, and disrupting the release of the cut pattern.

Figure 6:
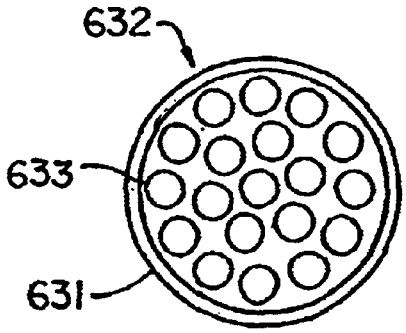
FIG. 6 illustrates a preferred embodiment of a vacuum port pattern for the vacuum plenum.
Figure 7:
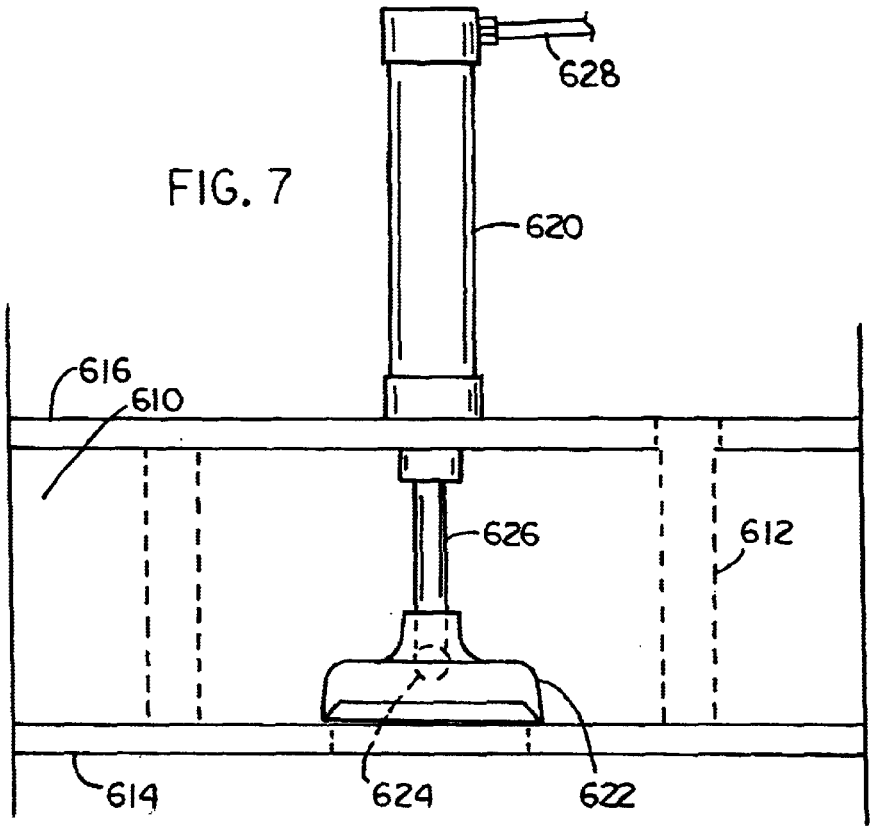
FIG. 7 shows a vacuum cylinder assembly in a sealed position.

FIG. 6 shows a typical vacuum port array or pattern 632, containing a plurality of vacuum ports 633. The line 631 illustrates the position of the exterior circumference of the poppet valve 622 when the valve is in the closed or sealed position. The closed position is illustrated in FIG. 7.

Figure 8:
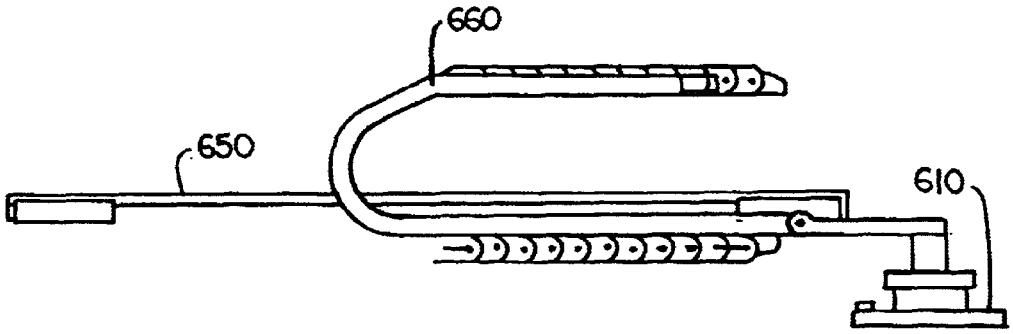
FIG. 8 shows a rear view of the vacuum plenum.
Figure 9:
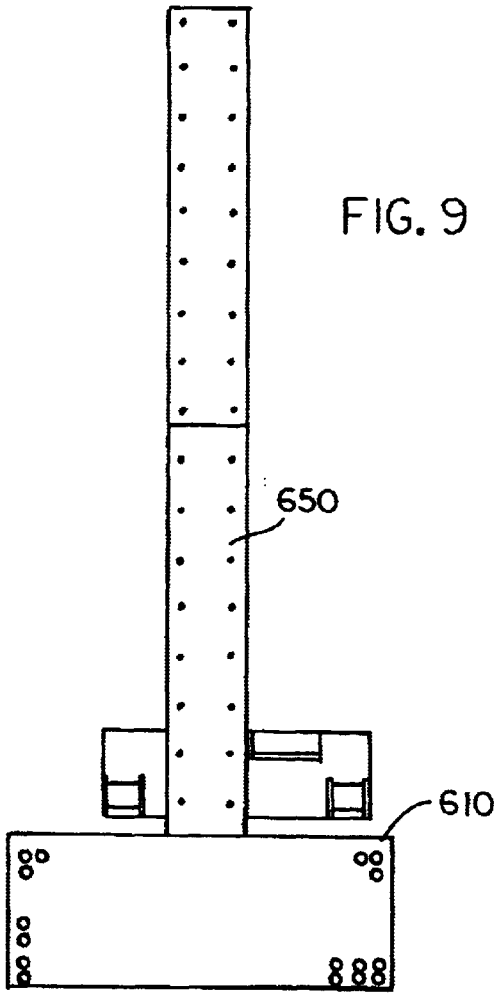
FIG. 9 shows a top view of the vacuum plenum.
Figure 10:
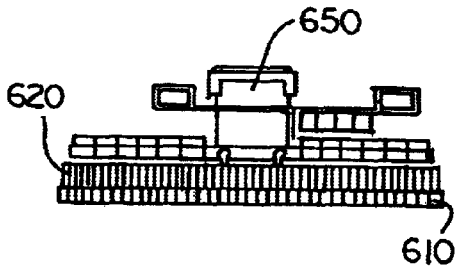
FIG. 10 shows a front view of the vacuum plenum.

FIGS. 8, 9 and 10 show a rear, top and front view, respectively, of a vacuum plenum 610. A plurality of valve cylinder assemblies 620 are shown on FIG. 10. Movement along the Y axis is accomplished with the servo slide 650, and cable harness 660.

While the present invention is intended for cutting fabric normally used in textiles, it is believed that the system could be adapted to cut virtually any cuttable "soft" material, such as fabric, leather or paper. The invention is especially well suited to assist in the manufacture of tubular knit fabrics, used in the construction of shirts and pants.

The controller 900 is an intelligent, microprocessor-based computer system, capable of storing in memory the desired stock patterns, data received from the inspection station 300, processing the information to minimize waste, and then signaling the cutter assembly 500 and pickup assembly 600 to properly operate as discussed above. Operating software can be any suitable programming language, such as V+ or AIM. With sufficient memory and storage devices, the controller can also track and record defects and cloth width variations for trend analysis. Moreover, defects can be classified to aid in troubleshooting fabric production problems.

Controller 900 can accept essentially any pattern. A particularly useful application arises when fabric sleeve patterns are desired, as illustrated in FIGS. 11 and 12.

Figure 11:
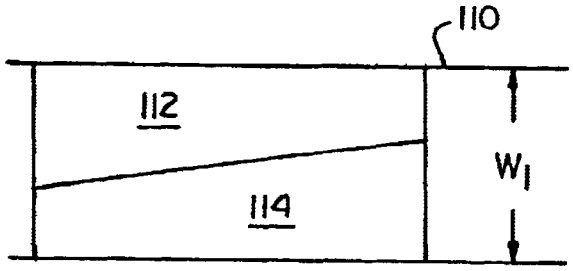
FIG. 11 shows two sleeve patterns in a first position.

FIG. 11 shows stock fabric 110 with width W1. Two sleeve patterns, 112 and 114, are shown after cutting. The sleeve patterns are placed on the stock so that all of the width W1 is consumed, and there is no waste above and below the sleeves.

Figure 12:
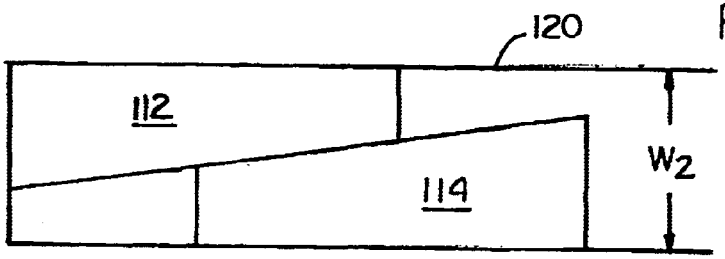
FIG. 12 shows two sleeve patterns in a second position.

FIG. 12 shows stock fabric 120, but with width W2, which is smaller than W1. In order to obtain the same sleeve patterns, pattern 114 is shifted to the right in FIG. 12. In other words, the cutter assembly 500 is instructed by the controller 900 to delay cutting the second sleeve pattern 114. Thus, the stock 110 is used all the way to both edges, while the same size sleeve patterns are obtained. Without the ability to shift one of the sleeves, the resultant sleeves would have been smaller than desired. The ability to cut the same sleeve pattern, regardless of minor variations in the stock width ensures proper sleeve patterns of uniform dimensions. Prior art die cutting operations were forced to accept stock width variations, resulting in inconsistent sleeve patterns.

Figure 13:
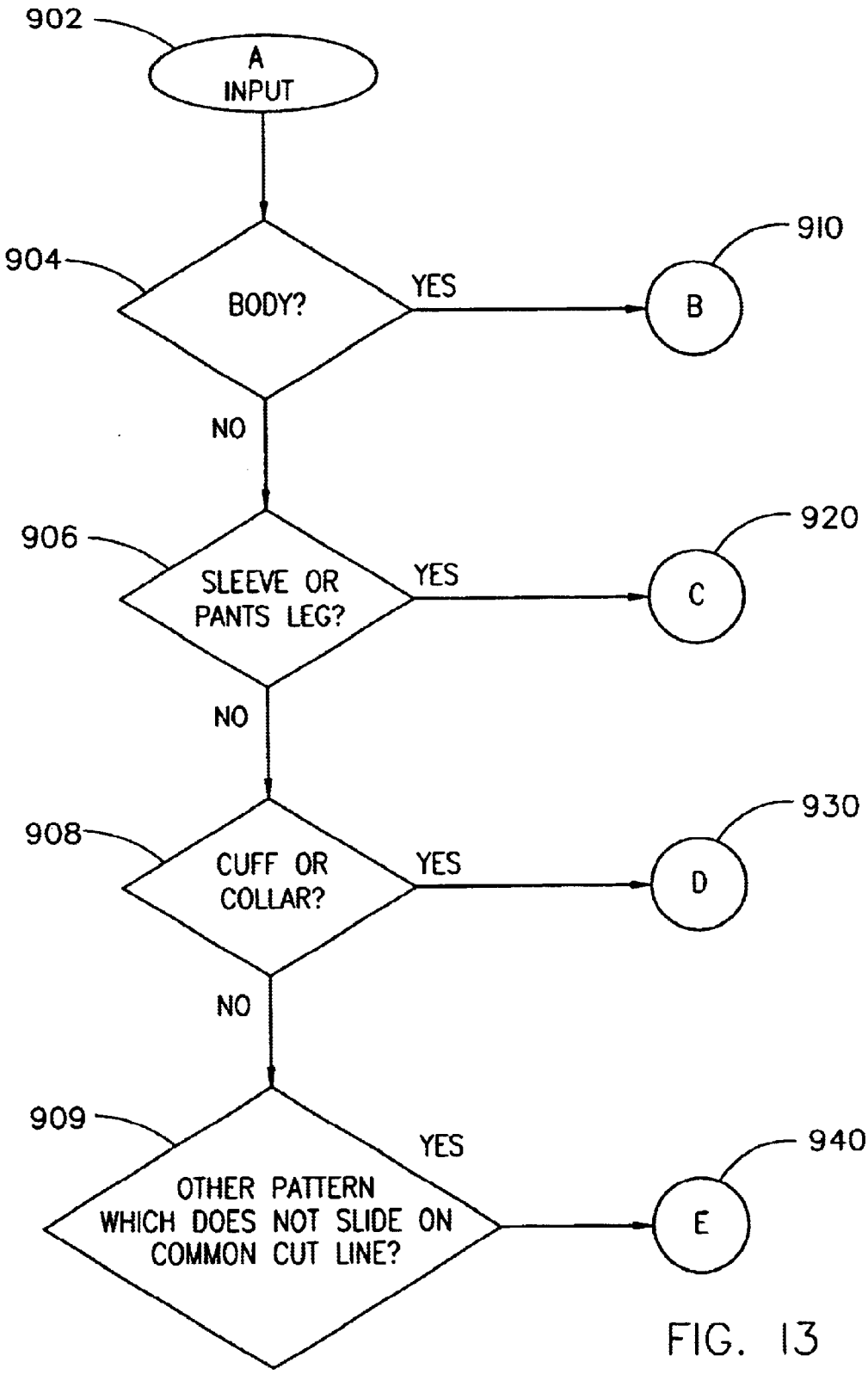
FIGS. 13 through 17 illustrate flow charts for the preferred cutting method.

FIG. 13 illustrates one cutting method used by this invention. The initial setup of the system requires the specification of the shape and type of pattern that will be cut and stacked. Stock width is also required. The type of pattern and stock width is input at step 902. The first question, at step 904, queries whether the pattern is a shirt body, or other pattern that spans the width of the fabric. If YES, proceed to step B, 910. If NO, then the next query occurs at step 906. If the pattern is a sleeve or pants leg, then proceed to C, 920. If not, the next query is whether the pattern is a cuff or collar at step 908. If YES, then proceed to D, 930. If NO, then the pattern presumably is a pattern that does not slide on a common cut line 909, and proceed to E, 940.

Figure 14:
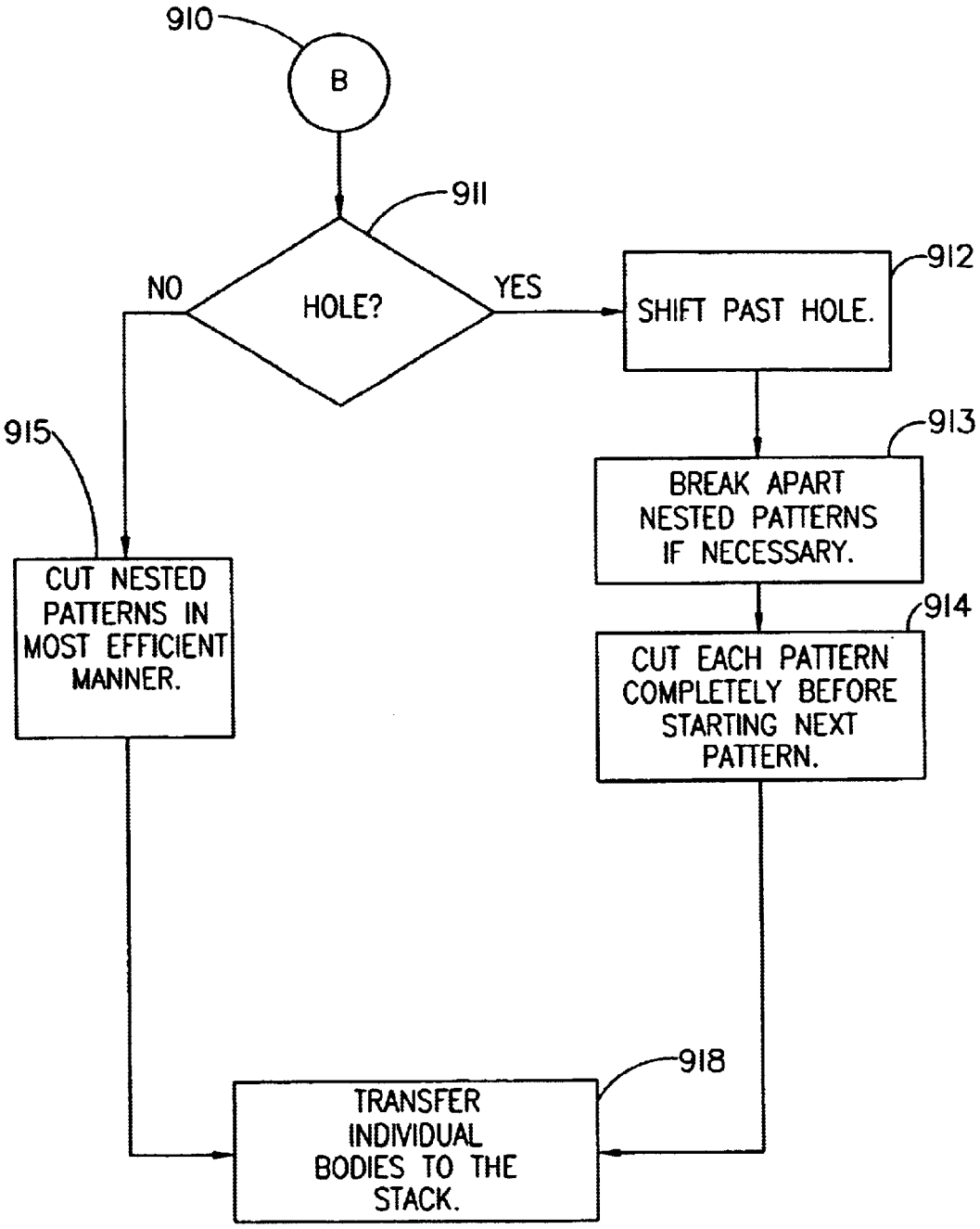

FIG. 14 illustrates the decision flow for a body or other pattern that will span the width of the fabric. At step 910, adjustments in the pattern can be made so that the entire width of the fabric is used. In the cutting of fabric for shirts, for example, the fabric can be 2-ply tubular knitted. A shirt body pattern is laid out so that the neck openings are matched to the edge, which is a fold edge, of the cloth. Centering the arm openings along the center line of the fabric allows the neck openings and sleeve cuts to be consistent. In this manner, variations in the width of the fabric contribute to variations in shoulder cut only. Prior art methods, such as those using BRB die cuts, either resulted in too much waste, or caused undesirable variations in neck openings or sleeve cuts. Since BRB and other conventional die cut operations could not vary the cut pattern based upon stock width variations, imperfect cuts and high waste resulted.

The inspection station then determines whether a defect or hole exists, step 911, in the stock fabric. If YES, then the cutter shifts past the hole, step 912, breaking apart nested or grouped patterns if necessary, step 913. Restrictions, step 914, are placed in the software to ensure that each pattern is cut completely before starting on the next pattern. After cutting, the pickup assembly 600 is properly instructed, step 918, to pickup the cut pattern, and transfer the cut pattern to the proper stacking station 700. If the inspection station detects no hole, the patterns are laid out, step 915, to minimize waste and ensure cutting is performed in the most efficient manner. Alternatively, the patterns can be cut with the defect in the pattern, depending upon whether irregulars are acceptable.

Figure 15:
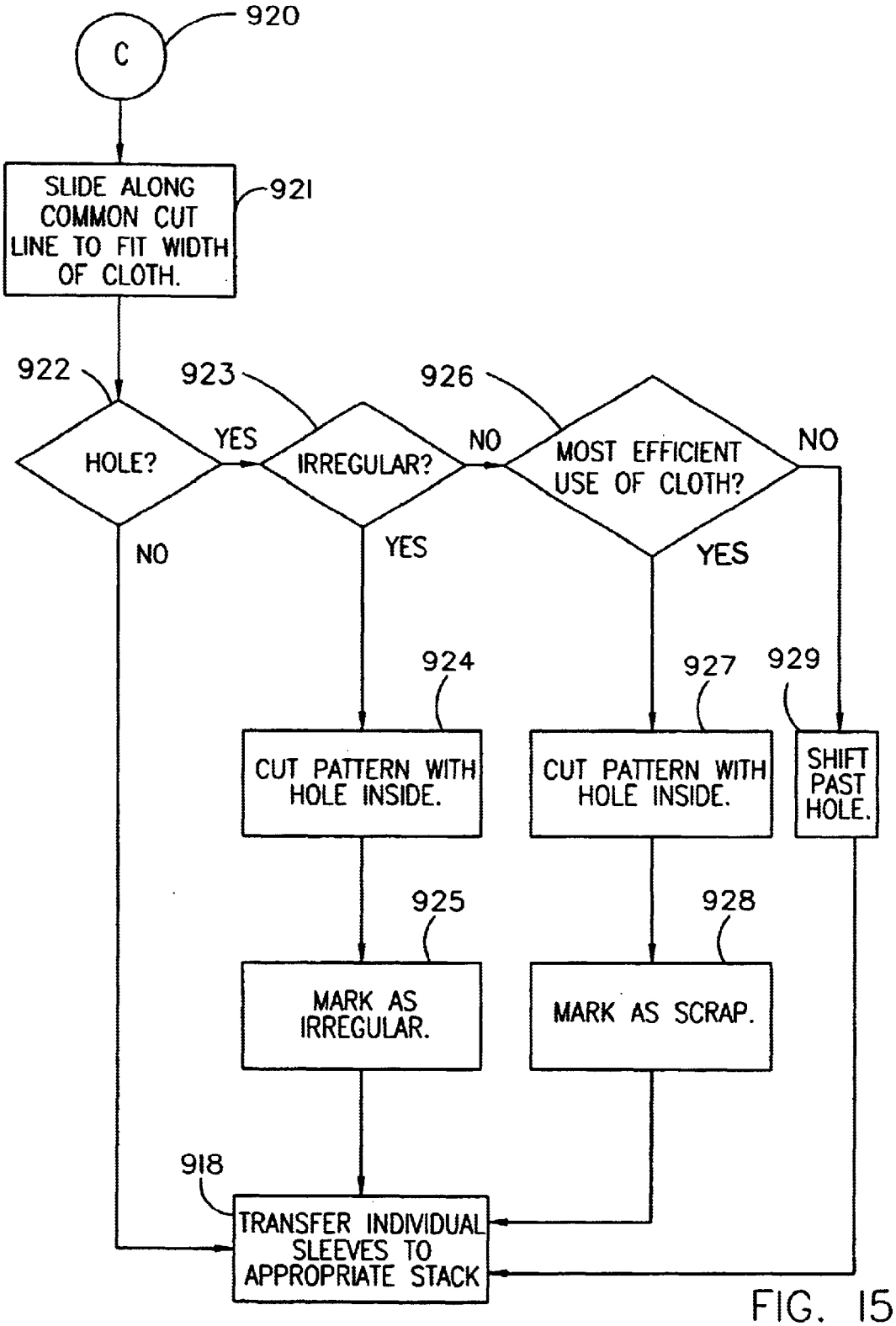

FIG. 15 shows the treatment of a sleeve or pants leg. Since such patterns by definition come in pairs, the patterns are placed, at step 921, on the stock along a common cut line and shifted as necessary to fit the width of the cloth. (See discussion above for sleeves accompanying FIGS. 11 and 12.) At step 922, the existence of a hole or other defect is queried. Depending upon the size, nature and location of the defect, at step 923 the decision may be made to cut the defect into the pattern step 924, and then mark the pattern as an irregular step 925. At step 926, (where it has been determined that if the pattern includes a hole, it will be scrap) the decision is made concerning the most efficient treatment of the defect. Due to many factors, such as the patterns shapes, placement of adjacent patterns, size of the run, prior shifting, etc., it may be most efficient to simply cut the pattern with the hole inside the pattern 927, and then mark the pattern as scrap 928. Otherwise, the patterns can be shifted past the defect 929. The pickup assembly 600 will then be alerted, step 918, to pickup the correct patterns, and transfer them to the proper stacking station 700 depending upon their pattern, and treatment as irregular, scrap or first quality. Note that if irregulars are not required or desired, the processor can go immediately from step 922 to step 926.

Figure 16:
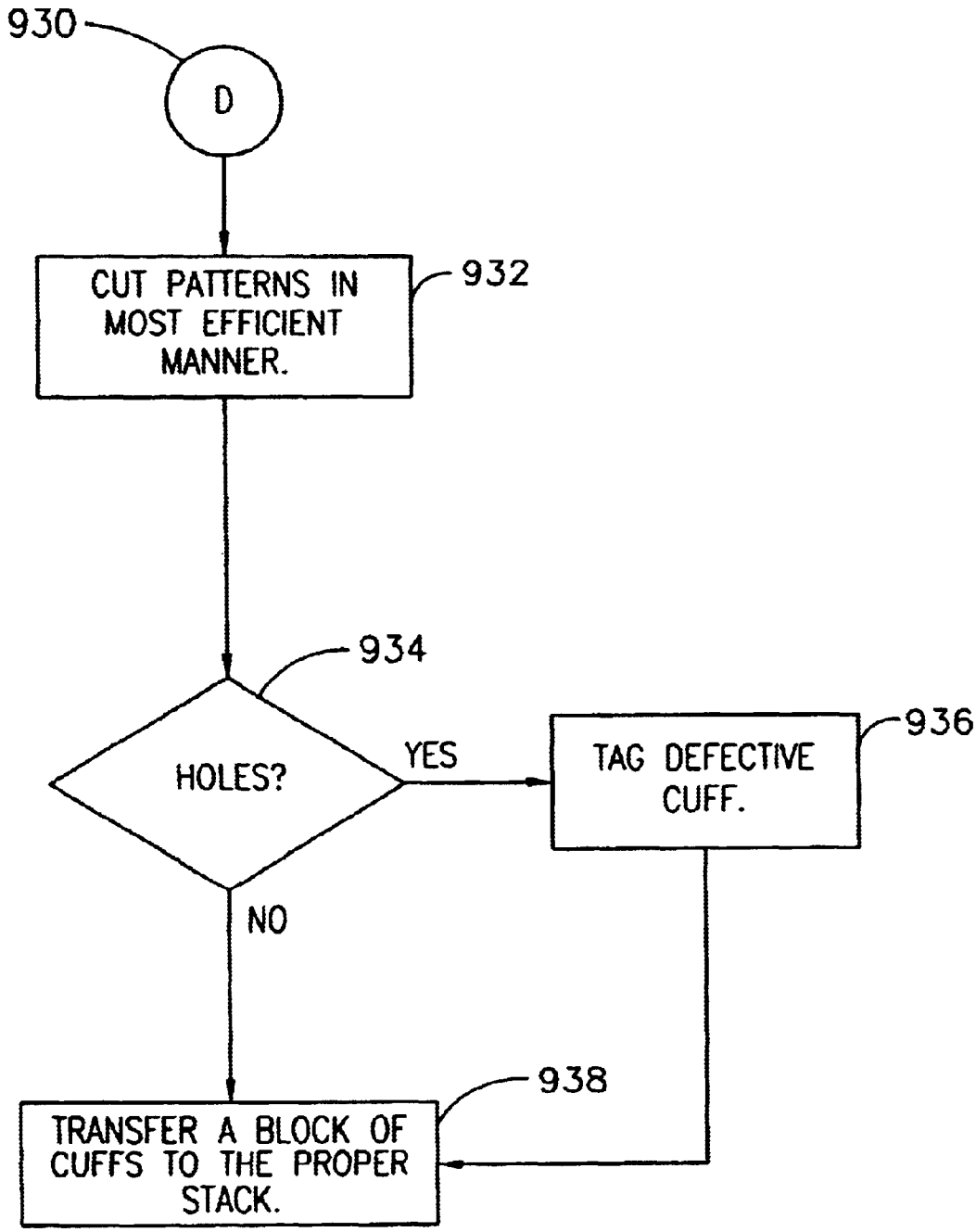

FIG. 16 shows the treatment of cuffs and collars. As before, at step 932 the patterns are laid out in the most efficient manner, depending upon the shapes of the cuffs or collars, the shapes of the neighboring or adjacent patterns, and fabric width. If holes are detected, step 934, typically the cuff or collar is cut with the defect contained therein 936, and then the defective collar is delivered 938 by the pickup assembly to the appropriate stacking station. Cuffs and collars are transferred as groups, including any defective ones. The defective ones are "tagged" in software but not necessarily sorted or stacked in a separate stack. If no defect is detected, the pattern is cut and picked up and transferred 938 to the proper stacking station.

Figure 17:
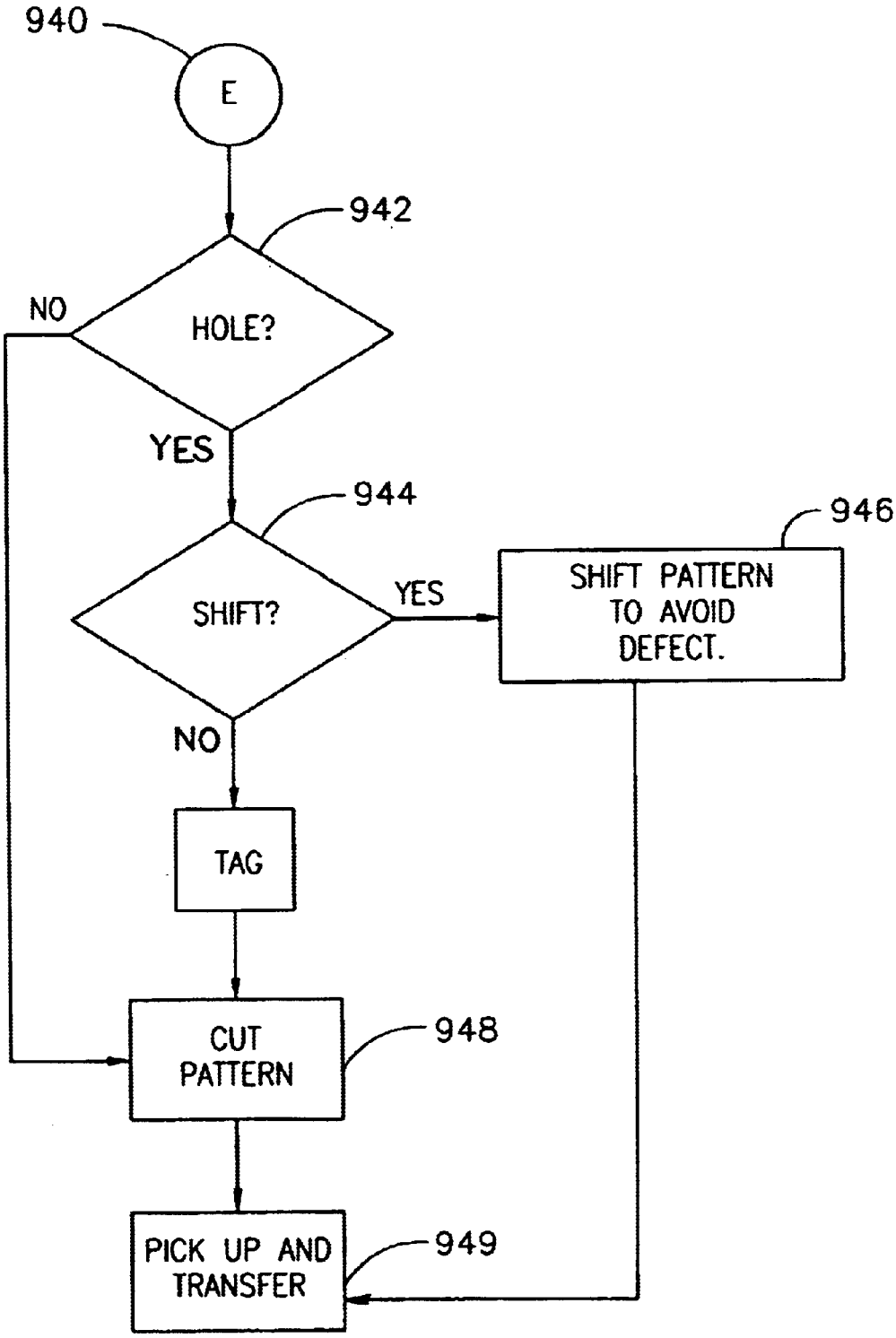

For other patterns that did not fall within any of the above-mentioned shapes or styles, FIG. 17 illustrates the decision flow. At step 940, the pattern is laid out on the fabric stock, minimizing stock waste. If a hole is detected, 942, the question is then asked whether to shift past the defect, or cut the pattern with the defect, step 944. The decision can be determined prior to the run due to the desirability for irregular patterns, or can be made based upon the size, character and location of the defect. For example, if the defect is on fabric that may be on the underside of a garment, the defect may be included in the pattern with little impact upon the final quality of the garment. Alternatively, the pattern may be cut as is, and then still discarded as scrap or waste. If the pattern is shifted past the defect, step 946, the pattern is then cut 948. The controller has tracked the location of the pattern, and the pattern is then 949 picked up and transferred to the proper stacking location. If the pattern is not shifted, then the pattern is cut within the defect therein 948. The pattern, properly marked as first quality, irregular or scrap, is then disposed of in the proper manner, step 949. Note that if the pattern was cut with a defect, but the defect was so great to require the pattern to be identified as waste, then the pickup assembly will not be instructed to pickup the pattern, allowing it to fall to the waste station 800. If no defect is detected, the pattern is cut 948 and transferred to the stacking station 949.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A fabric cutting system for cutting a pre-selected pattern from a fabric stock and transferring the cut fabric piece to a workstation, said system comprising:

(a) a cutter assembly for cutting said preselected pattern from said fabric stock;

(b) a configurable pickup assembly located between said cutter assembly and said workstation for picking-up and transferring said cut fabric piece to said workstation, said pickup assembly including: (i) a vacuum plenum having at least one generally flat surface; (ii) a plurality of orifices arranged about said surface; (iii) a valve actuator connected to said plenum and to a valve that selectively closes at least a portion of said orifices for generally corresponding to the shape of the cut fabric piece; and (iv) a controller in communication with the valve actuator, whereby said cut fabric piece is picked up and transferred to said workstation;

(c) a hold down table adjacent to said cutter assembly to maintain the position of the fabric stock in a determinable relationship to the position of said cutter assembly and said configurable pickup assembly; and (d) a vacuum source positioned within said hold down table for applying a pressure to the fabric stock, said vacuum source having at least one adjusting plate that is substantially parallel to a work support surface of said hold down table and is transversely adjustable along a width dimension of said hold down table so as to be transversely adjustable along a width dimension of said fabric stock thereby controlling the pressure along the edges of the fabric stock, whereby the edges of the fabric stock are subjected to a lower pressure than the remainder of the fabric stock.

2. The fabric cutting system according to claim 1 wherein the fabric stock is maintained in determinable relationship to said cutter assembly and said pickup assembly by said vacuum source positioned within the hold down table applying a pressure to the fabric stock.

3. The fabric cutting system according to claim 2 wherein said pressure is between about 2 to 4 inches of water.

4. The fabric cutting system according to claim 1 wherein said hold down table includes a belt that is parallel to at least one surface of the hold down table for moving the fabric stock from a first position to at least a second position.

5. The fabric cutting system according to claim 4 wherein said belt includes an open mesh structure through which a pressure differential can be created.

6. The fabric cutting system according to claim 4 further including a belt drive contacting the belt for conveying the belt.

7. The fabric cutting system according to claim 6 wherein said belt drive continuously moves the belt during operation of said cutter assembly and said pickup assembly.

8. The fabric cutting system according to claim 1 wherein said cutter assembly is positionable horizontally and vertically, said cutter assembly including a rotatably and detachably mounted cutter head.

9. The fabric cutting system according to claim 1 wherein said cutter assembly comprises a cutter head, and wherein the cutter head is a shear-type cutter.

10. The fabric cutting system according to claim 9 wherein said cutter head includes a first blade, and a second blade, the first blade being biased against the second blade.

11. The fabric cutting system according to claim 1 wherein said cutter assembly further includes a crash protection device.

12. The fabric cutting system according to claim 1 wherein said cutter assembly further includes a pneumatic cloth feed assembly.

13. The fabric cutting system according to claim 1 wherein said vacuum plenum is generally rectangular in shape.

14. The fabric cutting system according to claim 13 wherein said vacuum plenum is placed under a vacuum of between about 2 to 4 inches of water.

15. The fabric cutting system according to claim 1 wherein each of said plurality of orifices is generally circular in shape, and between about 0.1 to 0.2 inches in diameter.

16. The fabric cutting system according to claim 1 wherein the number of said plurality of orifices is between about 18 to 30 per square inch.

17. The fabric cutting system according to claim 1 wherein said valve actuator for selectively closing at least a portion of the orifices includes at least one valve cylinder assembly having a vacuum cylinder with a first position and second position; and wherein the valve is positioned adjacent to said orifices and coupled to said vacuum cylinder to seal the orifices when the vacuum cylinder is in the second position.

18. The fabric cutting system according to claim 17 wherein said valve is mounted on said vacuum cylinder for angular compliance with said orifices.

* * * * *

UNITED STATES PATENT AND TRADEMARK OFFICE

CERTIFICATE OF CORRECTION

PATENT NO. : 6,823,763 B1
DATED : November 30, 2004
INVENTOR(S) : Wayne G. Foster et al.

It is certified that error appears in the above-identified patent and that said Letters Patent is hereby corrected as shown below:

Title page,
Item [75], Inventors, should read -- Wayne G. Foster, Winston-Salem, NC (US); Ken J. Thompson, Lexington, NC (US); John R. Everhart, Winston-Salem, NC (US); Erik D. Moore, Lexington, NC (US); Joel C. Rosenquist, Kernersville, NC (US); Michael D. Hines, Lewisville, NC (US); David S. Trotter, Winston-Salem, NC (US) --

Signed and Sealed this

Tenth Day of May, 2005

JON W. DUDAS
*Director of the United States Patent and Trademark Office*